United States Patent [19]

Tharman

[11] Patent Number: 4,984,543

[45] Date of Patent: Jan. 15, 1991

[54] OIL PRESSURE INTERLOCK SWITCH POWERED BY THE ENGINE STARTER

[75] Inventor: Paul A. Tharman, Milwaukee, Wis.

[73] Assignee: Briggs & Stratton Corporation, Wauwatosa, Wis.

[21] Appl. No.: 430,566

[22] Filed: Nov. 1, 1989

[51] Int. Cl.[5] ..... F02P 11/02

[52] U.S. Cl. ..... 123/179 A; 123/179 BG; 123/196 S; 123/198 DC; 123/630; 340/451

[58] Field of Search ..... 123/179 BG, 179 B, 179 A, 123/196 S, 198 DC, 630; 340/451

[56] References Cited

U.S. PATENT DOCUMENTS

| | | | |
|---|---|---|---|
| 2,722,673 | 11/1955 | Turner | 340/52 |
| 3,116,729 | 1/1964 | Crowe | 123/179 B |
| 3,356,082 | 12/1967 | Jukes . | |
| 3,362,388 | 1/1968 | Lindberg et al. | 123/630 |
| 3,521,612 | 7/1970 | Santi et al. | 123/179 |
| 3,581,720 | 6/1971 | Hemphill et al. . | |
| 3,601,103 | 8/1971 | Swiden | 123/198 D |
| 3,726,265 | 4/1973 | Howard | 123/179 K |
| 3,731,471 | 5/1973 | Bening | 56/10.5 |
| 3,733,794 | 5/1973 | Allen | 56/10.5 |
| 4,033,311 | 7/1977 | Burson | 123/179 K |
| 4,034,732 | 7/1977 | Van Burkleo | 123/198 DC |
| 4,054,117 | 10/1977 | Palmer et al. | 123/198 D |
| 4,059,087 | 11/1977 | Tanigami et al. | 123/196 S |
| 4,144,862 | 3/1979 | Estkowski | 123/196 S |
| 4,147,151 | 4/1979 | Wright | 123/198 DC |
| 4,294,327 | 10/1981 | Howard | 180/273 |
| 4,369,745 | 1/1983 | Howard | 123/198 DC |
| 4,445,470 | 5/1984 | Chmielewski | 123/196 S |
| 4,489,311 | 12/1984 | Lang et al. | 340/501 |
| 4,522,170 | 6/1985 | Lenk et al. | 123/198 DC |
| 4,622,935 | 11/1986 | Janisch | 123/198 DC |
| 4,684,917 | 8/1987 | Tharman | 340/59 |
| 4,754,732 | 7/1988 | Kuczenski et al. | 123/196 S |

FOREIGN PATENT DOCUMENTS

| | | | |
|---|---|---|---|
| 59-32675 | 2/1984 | Japan | 123/198 DC |

*Primary Examiner*—Andrew M. Dolinar

*Attorney, Agent, or Firm*—Andrus, Sceales, Starke & Sawall

[57] ABSTRACT

A starter-powered interlock switch means is provided for disabling a low oil pressure switch in power-driven apparatus such as lawn mowers, pumps, generators, tractors and the like. The interlock switch means disables the low oil pressure switch when the engine is not running to permit the engine to be easily started. Several embodiments of the interlock switch means are disclosed. The embodiments include a capacitor that is charged by the starter motor during cranking of the engine, and a relay switch that interrupts the circuit between the ignition primary and the low oil pressure switch to disable the low oil pressure switch. When the engine has started, the capacitor discharges to control one or more other switches that in turn close the circuit between the ignition primary and the low oil pressure switch. The closing of the latter circuit enables the low oil pressure switch to be activated when a low oil pressure condition is sensed.

15 Claims, 2 Drawing Sheets

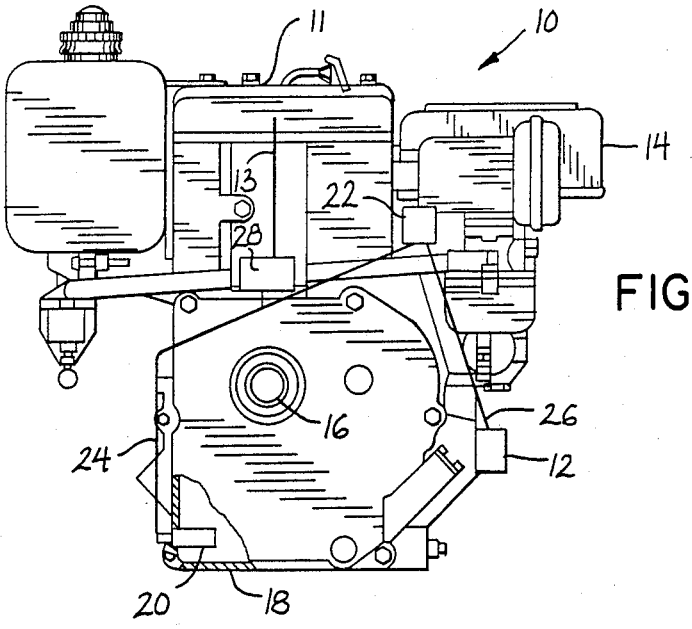
FIG. 1
FIG. 2
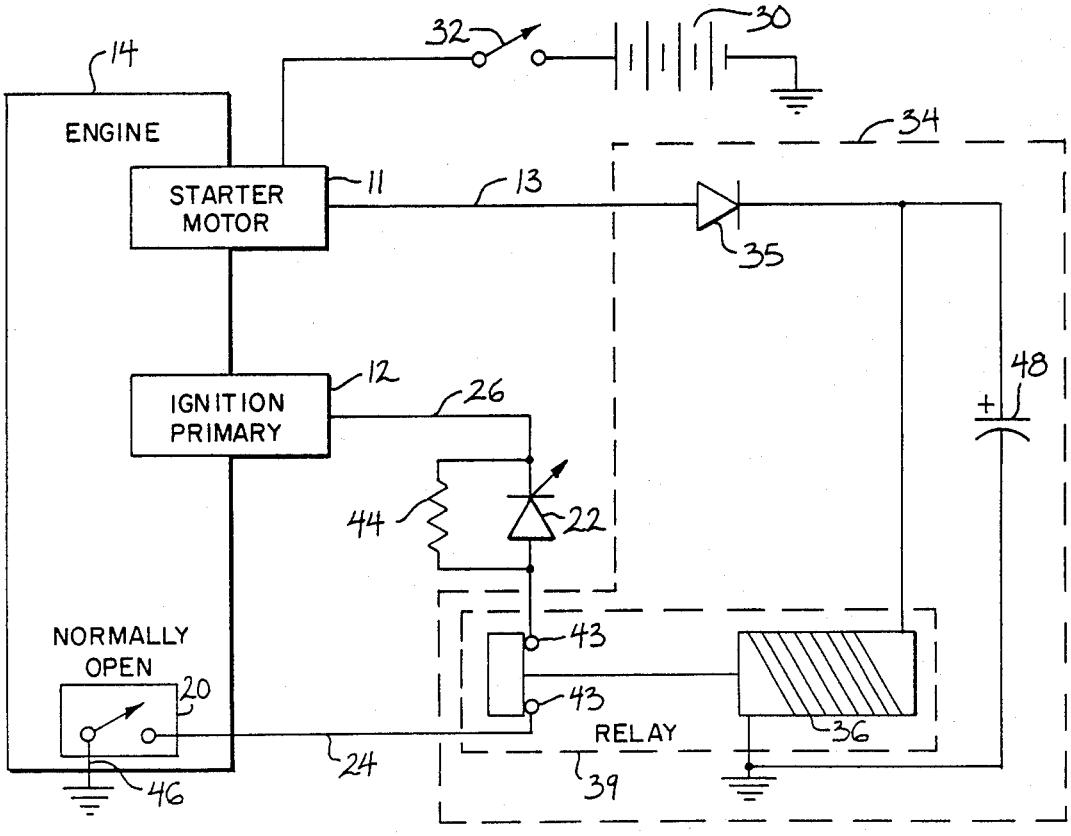

14
ENGINE
STARTER MOTOR
11
13
32
30
35
49
56
50
+12 VDC
48
54
52
12
IGNITION PRIMARY
26
44
22
NORMALLY OPEN
20
46
24
43
43
RELAY
36
39

14
ENGINE
STARTER MOTOR
11
13
35
32
30
74
56
48
54
66
12
IGNITION PRIMARY
26
+12 VDC
70
44
22
52
68
NORMALLY OPEN
20
43
43
24
RELAY
36
39
46

OIL PRESSURE INTERLOCK SWITCH POWERED BY THE ENGINE STARTER

BACKGROUND OF THE INVENTION

The present invention relates to low oil pressure switches which shut off an engine when the oil oil pressure is below a predetermined level. More particularly, the invention relates to an interlock switch for disabling a low oil pressure switch to permit the engine to be easily started.

Various types of low oil pressure switches are known which activate when the engine oil pressure is below a predetermined level. Some of these prior art switches are connected to indicator systems that provide an audible or visual signal when the oil pressure is too low.

When other types of oil pressure switches activate, they cause the engine to shut off to prevent engine damage. One such oil pressure switch is connected in series with the primary winding of the ignition system's main core, and is normally open. This type of switch closes when the oil pressure is below a predetermined level, thereby grounding the ignition pulse and stopping the engine.

Another type of oil pressure switch is normally closed when the engine is running. The switch then opens when the oil pressure is below a predetermined level, causing the engine to shut down.

A major problem with both of the above referenced shut-off switches is that the engine is thereafter difficult to start. Since the engine has been shut off due to low oil pressure, it is very difficult to generate a sufficient oil pressure by pulling or cranking the engine to then cause the oil pressure switch to deactivate. Moreover, such low oil pressure shut-off switches typically activate while the engine is being shut off for any reason since the sensed oil pressure is low as the engine is winding down. In addition, the operator may not know why the engine will not start, and may attempt to find other possible problems with the engine which prevent it from starting.

It is thus desirable to provide a means for starting an engine which has been shut down, and at the same time to indicate to the operator that the oil pressure is low.

SUMMARY OF THE INVENTION

A starter motor-powered interlock switch means is provided for disabling a low oil pressure switch when the engine is not running or when the engine is being started, in power-driven apparatus such as lawn mowers, pumps, generators, tractors and like having an internal combustion engine. The engine includes an ignition system having a main core that includes a primary winding and a secondary winding, and a low oil pressure switch which shorts the ignition pulses to ground if a low oil pressure condition exists. The interlock switch means is powered by the starter motor that also starts the engine. In a preferred embodiment, an indicator means powered by the ignition primary informs the operator of a low oil condition.

Several embodiments of the interlock switch means are disclosed. In one embodiment, the interlock switch means comprises a blocking diode having its anode connected in series with the starter motor, a capacitor connected in circuit with the cathode of the diode, and a relay switch. The capacitor is charged by current from the starter motor during cranking of the engine and generates a discharge signal during its discharge cycle to control the relay switch after the engine starts running. The relay switch enables or places the oil pressure switch in the ignition circuit after the engine starts running. The interlock switch means may also comprise a first switch means, connected in circuit with the capacitor and with the relay switch, for controlling the relay switch.

The relay contacts of the relay switch are open during cranking of the engine to disable the low oil pressure switch; the relay contacts close in response to the capacitor's discharge signal to enable the low oil pressure switch. The first switch means may include an electronic switch, connected in circuit between the capacitor and the relay switch, for activating the relay switch in response to the discharge signal from the capacitor.

In another embodiment, the interlock switch means may comprises a blocking diode and a capacitor as before, a first switch means that is turned on to generate a control signal when the capacitor is charging and which is turned off in response to a discharge signal from the capacitor generated during the capacitor's discharge cycle, and a relay switch. The relay contacts open in response to the control signal to disable the low oil pressure switch and close when the first switch means is turned off to enable the low oil pressure switch.

Any of the embodiments may include an indicator means connected in circuit with the ignition primary and with the low oil pressure switch to indicate that the low oil pressure switch has been activated. The indicator means preferably comprises a light emitting diode (LED) and a shunt resistor to protect the diode from an overcurrent condition.

It is a feature and advantage of the present invention to provide an interlock switch means for disabling a low oil pressure switch to allow an internal combustion engine to be easily started.

It is yet another feature and advantage of the present invention to provide an interlock switch means that is powered by starter motor current to disable a low oil pressure switch.

It is yet another feature and advantage of the present invention to provide a visual or audible indicator means, powered by the ignition pulse, for informing the operator that the engine oil pressure is below a predetermined level.

These and other features and advantages of the present invention will be apparent to those skilled in the art from the following detailed description and the attached drawings, in which:

BRIEF DESCRIPTION OF THE DRAWINGS

FIG. 1 is a schematic drawing of a generator incorporating the interlock switch means of the present invention;

FIG. 2 is a schematic drawing of a first embodiment of the present invention in which the interlock switch means includes a blocking diode, a capacitor, and a relay switch;

DETAILED DESCRIPTION

Figure 3:
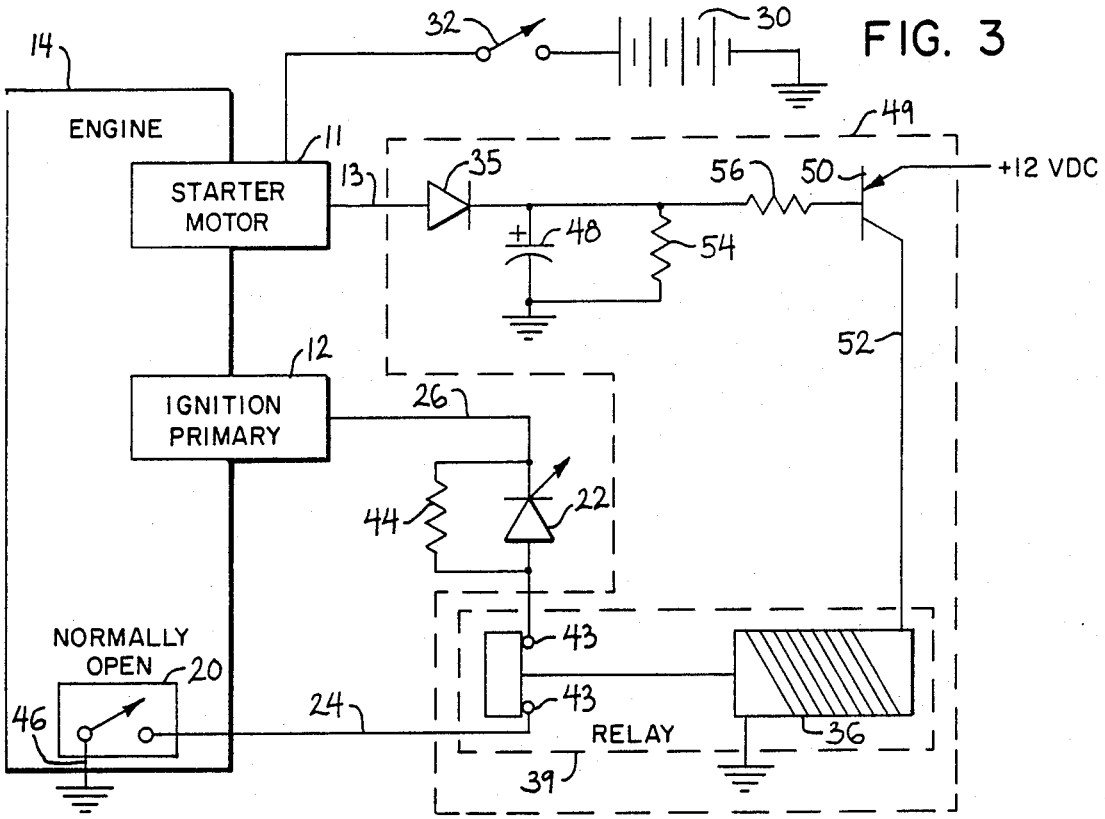
FIG. 3 is a schematic drawing of a second embodiment in which the interlock switch means includes a blocking diode, a capacitor, a PNP transistor, and a relay switch.

Referring now to FIG. 1, the principles of the invention are illustrated as being applied to a breakerless magneto-ignition system for a single cylinder internal combustion engine 14 that drives a generator 10. A magneto-ignition system having conventional mechanical breaker points could also be used. Starter motor 11, which may be powered by a battery or manually operated using a pull cord, generates current which starts engine 14. The principles of the invention are illustrated as being applied to a magneto-ignition system of the type used for powering tractors, lawn mowers, pumps, electrical generators, snow blowers and the like.

The ignition system of FIG. 1 includes a conventional magneto armature (not shown) having an induction coil consisting of a primary winding 12 that has a relatively small number of turns of relatively coarse wire, and a secondary winding (not shown) having numerous turns of relatively fine wire. The primary and secondary windings are inductively coupled with one another in a conventional manner by means of a ferromagnetic core (not shown) on which they are both wound. A spark plug (not shown) is connected across the terminals of the secondary winding. Although the invention is illustrated as being applied to a single cylinder internal combustion engine having only one spark plug, the invention may be used with engines having a plurality of spark plugs successively connected with the secondary winding in a known manner by means of a conventional distributor used with multicylinder engines.

To fire the spark plug, a circuit is closed to permit current to flow in the primary winding. That circuit remains closed at least long enough for the current flow in the primary winding to attain its full value, and is abruptly opened at the time the spark plug is to be fired, yielding a rapid collapse of the flux field that had been induced in the core by the current flow. The collapsing flux induces across the secondary winding a voltage high enough to produce an arc across the electrode to the spark plug, in a conventional manner.

Assuming that the present invention is incorporated into a single cylinder engine having a breakerless magneto-ignition system, the operation of the magneto requires that a circuit between the terminals of the primary winding be closed and opened by switching means operated in properly timed relation to the engine cycle. In the breakerless magneto-ignition system, mechanically actuated breaker points for controlling the flow of current to the primary winding are replaced by electronic switching means comprising a transistor device (not shown) and a small biasing or trigger coil (not shown) wound upon a second ferromagnetic core (not shown). The biasing coil and its corresponding second core cooperate with a permanent magnet assembly carried for orbital motion on a flywheel mounted on the engine crankshaft. The crankshaft rotates in timed relation to the engine cycle. The operation of the transistor device and biasing coil in cooperation with the armature core and permanent magnet assembly is described in detail in U.S. Pat. No. 4,270,509 to Paul A. Tharman, the subject matter thereof being specifically incorporated by reference herein.

Referring again to FIG. 1, generator 10 typically includes an internal combustion engine 14 having a crankshaft 16 and a crankcase 18 that contains oil or another lubricant for engine 14.

Starter current from starter 11 starts engine 14 and also powers interlock switch means 28 via line 13. Interlock switch means 28 is in turn connected to oil pressure switch 20 via line 24. LED 22 provides a visual indication that a low oil pressure condition exists. LED 22 could be replaced by a buzzer or other indicator means.

Oil crankcase 18 includes an oil pressure switch 20 which is connected to, and powered by, ignition primary 12 via lines 26 and 24. Oil pressure switch 20 is also connected to LED 22 via line 24. In the embodiments depicted in FIGS. 2–4, it is assumed that oil pressure switch 20 is normally open when engine 14 is running, but closes when the oil pressure in crankcase 18 is below a predetermined level. Oil pressure switch 20 typically closes when there is an oil leak, or when the engine runs too low on oil, or when the engine stops running for any reason. It is apparent that a normally closed type of oil pressure switch could be used in place of the normally open oil pressure switch 20, with suitable changes in the interlock switch means. The use of a normally closed oil pressure switch and suitable interlock switch means is still within the spirit and scope of the present invention.

Referring now to FIG. 2, the high voltage side of ignition primary 12 of engine 14 is connected in series with low oil pressure switch 20 and LED 22. A parallel shunt resistor 44 protects LED 22 from an overcurrent condition resulting from the high voltage ignition primary pulses. The indicator means consisting of LED 22 and shunt resistor 44 could be replaced by a different visual or audible apparatus which would indicate to the operator that a low oil pressure condition exists.

LED 22 is connected in series with normally open oil pressure switch 20 via line 24. Whenever oil pressure switch is closed and relay contacts 43 of relay 39 are closed, ignition primary pulses from ignition primary 12 are grounded at line 46 through line 26, LED 22, shunt resistor 44, line 24, and oil pressure switch 20. Relay contacts 43 are normally open during cranking of the engine, thereby disabling or taking switch 20 out of the ignition circuit. The opening of contacts 43 prevents ignition pulses from ignition primary 12 from being grounded, enabling engine 14 to start.

Engine 14 preferably uses an electric starter motor 11, although pull-type starters may also be used. A 12 volt battery 30 provides direct current to power starter motor 11 when starter switch 32 is closed.

The embodiment depicted in FIG. 2 includes an interlock switch means 34 whose purpose is to disable or take oil pressure switch 20 out of the ignition circuit during cranking or starting of engine 14, and to enable or place oil pressure switch 20 back in the ignition circuit once the engine is running. Interlock switch means 34 includes a blocking diode 35 whose anode is connected in series with starter motor 11, and whose cathode is connected with both relay 39 and electrolytic capacitor 48.

The circuit depicted in FIG. 2 operates in the following manner. When starter switch 32 is closed, battery 30 provides 12 volts of direct current to starter motor 11. Starter motor 11 cranks engine 14, and also powers interlock switch means 34 via line 13. The starter feeds current via blocking diode 35 to charge capacitor 48. While starter motor 11 is cranking the engine, relay contacts 43 of relay 39 are open, thereby disabling oil pressure switch 20 and allowing the engine to be started. After engine 14 is started, capacitor 48 enters its discharge cycle and generates a discharge signal to the first switch means relay 39. This discharge signal energizes relay solenoid coil 36, causing relay contacts 43 to close. The closing of relay contacts 43 enables oil pressure switch 20 to be placed back into the ignition circuit.

Oil pressure switch 20, which had been closed while the engine was shut off and during cranking, typically opens once the engine is started since it now senses that the oil pressure is above the predetermined level. Of course, if the sensed oil pressure is still low, oil pressure switch 20 will either remain closed or will open briefly and then close, shorting ignition primary pulses to ground. The time delay of capacitor 48 allows engine 14 to come up to a speed at which oil pressure switch 20 should sense that the oil pressure is above the predetermined level unless, of course, the oil pressure is low due to an oil leak or the like. After engine 14 is started, starter switch 32 is opened to disable starter motor 11. Starter switch 32 could be replaced by a starter solenoid.

FIG. 3 depicts another embodiment of the interlock switch means according to the present invention. In FIG. 3, as in all of the figures, corresponding components having corresponding functions have been given the same numerical designations; it is understood that particular values of these components may differ in the different embodiments depicted and described herein.

In FIG. 3, interlock switch means 49 includes blocking diode 35, capacitor 48, resistors 54 and 56, a first switch means 50, and relay switch 39. First switch means 50 is preferably a PNP bipolar transistor, although other switches could be used.

The interlock switch means in FIG. 3 operates as follows. Ignition pulses from ignition primary 12 are shorted to ground when engine 14 is running and oil pressure switch 20 is closed via lines 26, LED 22, shunt resistor 44, closed relay contacts 43, line 24, oil pressure switch 20, and line 46. As in FIG. 1, relay contacts 43 are normally open when engine 14 is being started, thereby disabling oil pressure switch 20 and preventing ignition pulses from ignition primary 14 from being shorted to ground.

To start engine 14, starter switch 32 is closed, allowing battery 30 to provide a 12 volt direct current signal to starter motor 11. As starter motor is cranking engine 14, starter current from starter motor 11 travels via line 13 and blocking diode 35 to charge capacitor 48. While capacitor 48 is being charged, PNP bipolar transistor 50 is turned off. When transistor 50 is turned off, no control signal is present on line 52, the line that connects transistor 50 to relay solenoid 36. Relay contacts 43 are then open. After engine 14 has started, capacitor 48 generates a discharge signal during its discharge cycle through resistors 54 and 56, which are connected to the base of transistor 50. The discharge signal turns on transistor 50, resulting in a control signal being generated by transistor 50 via line 52 to relay solenoid 36. The control signal activates relay 39, causing relay contacts 43 to be closed. The closing of relay contacts 43 enables or places oil pressure switch 20 back in the circuit. Switch 20 is typically open once engine 14 has started and has reached a certain number of revolutions per minute since the sensed oil pressure is then above a predetermined level.

Figure 4:
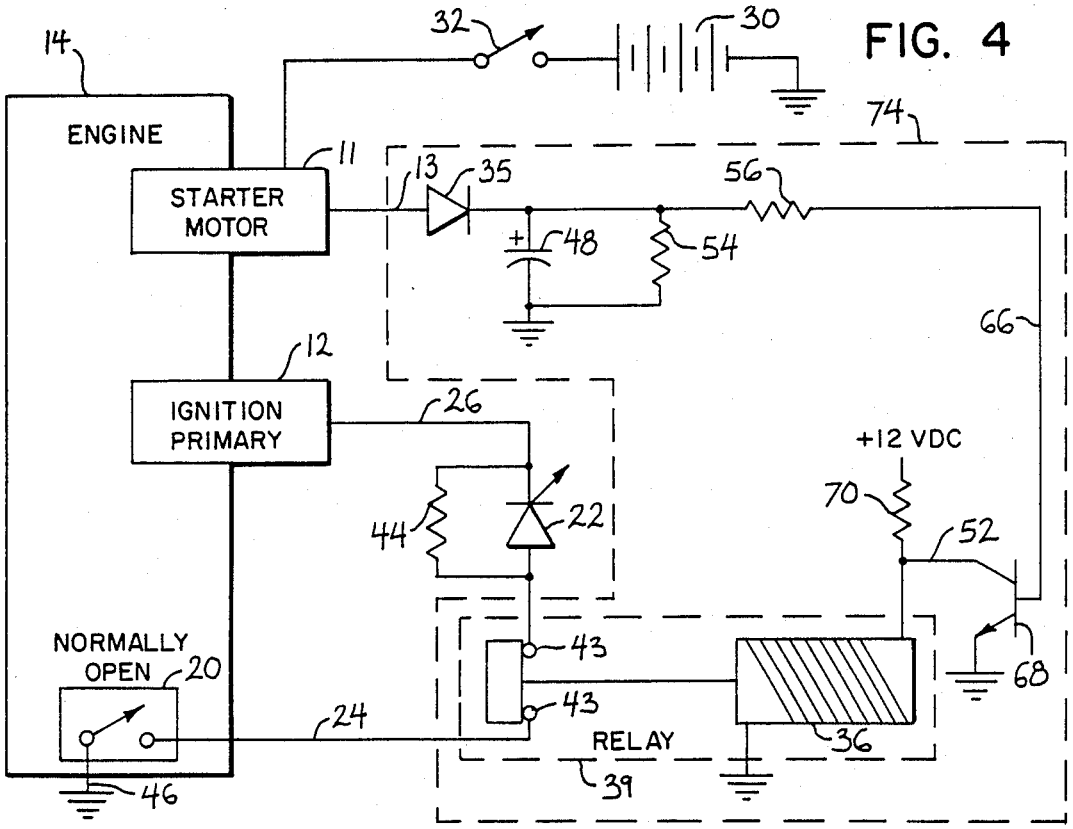
FIG. 4 is a schematic drawing of a third embodiment in which the interlock switch means includes a blocking diode, a capacitor, an NPN transistor, and a relay switch.

FIG. 4 depicts another embodiment of the interlock switch means according to the present invention. In FIG. 4, the interlock switch means 74 includes blocking diode 35, capacitor 48, resistors 54 and 56, a first switch means 68, and a relay 39. The first switch means 68 is preferably a bipolar NPN transistor, although other mechanical or electronic switches could be used.

The circuit depicted in FIG. 4 operates as follows. When engine 14 is not running, low oil pressure switch 20 is closed and relay contacts 43 are open. Thus, ignition pulses from ignition primary 12 during cranking of the engine are not grounded, since oil pressure switch 20 has effectively been disabled by interlock switch means 74. However, once the engine is started, relay contacts 43 are closed, enabling low oil pressure switch 20 to be in the ignition circuit. Any thereafter sensed low oil pressure condition will cause ignition pulses to be grounded at line 46 via line 26, LED 22, shunt resistor 44, closed relay contacts 43, line 24, and closed switch 20.

To start engine 14, starter switch 32 is closed, enabling the 12 VDC signal from battery 30 to energize starter motor 11. While starter motor 11 is cranking engine 14, starter current charges capacitor 48 via line 13 and blocking diode 35. While capacitor 48 is being charged, a control signal passes through line 66 to the gate of transistor 68, turning on NPN transistor 68. The turning on of transistor 68 causes the 12 VDC power supply connected to resistor 70 to be shorted to ground via line 52 and transistor 68.

Once starter motor 11 has started the engine, capacitor 48 enters its discharge cycle, and generates a discharge signal through resistors 54 and 56 and line 66 to turn off NPN transistor 68. The turning off of transistor 68 allows the 12 VDC power supply connected to resistor 70 to energize relay solenoid coil 36 of relay 39. The energizing of relay solenoid 36 closes relay contacts 43, thereby completing the circuit between ignition primary 12 and low oil pressure switch 20. The closing of contacts 43 enables low oil pressure switch 20 to be back in the ignition circuit. The timing cycle of capacitor 48 permits engine 14 to reach a sufficient number of revolutions per minute so that the engine oil pressure sensed by oil pressure switch 20 should be above the predetermined safe level. Thus, switch 20 should be open once the engine is started. If switch 20 thereafter senses that the oil pressure is below the predetermined level, ignition pulses from ignition primary 12 will be shorted to ground since relay contacts 43 are closed while the engine is running and since switch 20 will then be closed as well.

Several embodiments of the present invention have been discussed above and depicted in the drawings. However, additional alternate embodiments will be apparent to those skilled in the art and are contemplated as being within the scope of the present invention. Therefore, the scope of the present invention is to be limited only by the following claims.

We claim:

1. In an apparatus having an internal combustion engine, a starter motor for starting the engine, and a magneto-ignition system having a main core that includes a primary winding to produce an ignition pulse, and having a low oil pressure switch that activates when the engine oil pressure is below a predetermined level, the improvement comprising:

an interlock switch means for disabling said low oil pressure switch when the engine is not running, said interlock switch means being connected in circuit with both said starter motor and with said low oil pressure switch, said interlock switch means including:

a relay switch;

a diode having its anode connected in series with said starter motor;

a capacitor connected in circuit with the cathode of said diode, said capacitor being charged by current from said starter motor during cranking of said engine and generating a discharge signal during its discharge cycle after said engine starts running; and a first switch means, connected in circuit between said capacitor and said relay switch, for activating said relay switch in response to the discharge signal from said capacitor.

2. The improvement of claim 1, wherein said first switch means comprises an electronic switch.

3. The improvement of claim 1, wherein said first switch means comprises a bipolar transistor.

4. In an apparatus having an internal combustion engine, a starter motor for starting the engine, and a magneto ignition system having a main core that includes a primary winding to produce an ignition pulse, and having a low oil pressure switch that activates when the engine oil pressure is below a predetermined level, the improvement comprising:

an interlock switch means, connected in circuit with both said starter motor and with said low oil pressure switch and powered by said starter motor, for disabling said low oil pressure switch when the engine is not running, including a diode having its anode connected in series with said starter motor;

a capacitor connected in circuit with the cathode of said diode, said capacitor being charged by current from said starter motor during cranking of said engine and generating a discharge signal during its discharge cycle after the engine starts running; and a relay switch connected in circuit with said capacitor and with said low oil pressure switch whose relay contacts are open during cranking of the engine to disable said low oil pressure switch, and whose relay contacts close in response to the discharge signal to enable said low oil pressure switch.

5. The improvement of claim 4, further comprising:

an indicator means, connected in circuit with said low oil pressure switch, for indicating when the engine oil pressure is below the predetermined level.

6. The improvement of claim 5, wherein said indicator means comprises:

a light emitting diode (LED); and a resistor connected in parallel with said light emitting diode that protects said diode from an overcurrent condition.

7. In an apparatus having an internal combustion engine, a starter motor for starting the engine, and a magneto ignition system having a main core that includes a primary winding to produce an ignition pulse, and having a low oil pressure switch that activates when the engine oil pressure is below a predetermined level, the improvement comprising:

an interlock switch means, connected in circuit with both said selector motor and with said low oil pressure switch and powered by said starter motor, for disabling said low oil pressure switch when the engine is not running, including a diode having its anode connected in series with said starter motor;

a capacitor connected in circuit with the cathode of said diode, said capacitor being charged by current from said starter motor during cranking of said engine and generating a discharge signal during its discharge cycle after the engine starts running;

a first switch means, connected in circuit with said capacitor, for turning off when said capacitor is being charged and for turning on to generate a control signal in response to said discharge signal; and a relay switch, connected in circuit with said first switch means and with said low oil pressure switch, whose contacts close in response to the control signal to enable said low oil pressure switch.

8. The improvement of claim 7, wherein said first switch means comprises a PNP transistor.

9. The improvement of claim 7, further comprising:

an indicator means, connected in circuit with said low oil pressure sitch, for indicating when the engine oil pressure is below the predetermined level.

10. The improvement of claim 9, wherein said indicator means comprises:

a light emitting diode (LED); and a resistor connected in parallel with said light emitting diode that protects said diode from an overcurrent condition.

11. In an apparatus having an internal combustion engine, a starter motor for starting the engine, and a magneto ignition system having a main core that includes a primary winding to produce an ignition pulse, and having a low oil pressure switch that activates when the engine oil pressure is below a predetermined level, the improvement comprising:

an interlock switch means, connected in circuit with both said starter motor and with said low oil pressure switch and powered by said starter motor, for disabling said low oil pressure switch when the engine is not running, including a diode having its anode connected in series with said starter motor;

a capacitor connected in circuit with the cathode of said diode, said capacitor being charged by current from said starter motor during cranking of said engine and generating a discharge signal during its discharge cycle after the engine starts running;

a first switch means, connected in circuit with said capacitor, for turning on to generate a control signal when the capacitor is charging and for turning off in response to the discharge signal; and a relay switch, connected in circuit with said first switch means and with said low oil pressure switch, whose contacts open in response to the control signal to disable the low oil pressure switch, and whose contacts close when said first switch means is turned off to enable said low oil pressure switch.

12. The improvement of claim 11, wherein said first switch means comprises an NPN transistor.

13. The improvement of claim 11, further comprising:

an indicator means, connected in circuit with said low oil pressure switch, for indicating when the engine oil pressure is below the predetermined level.

14. The improvement of claim 13, wherein said indicator means comprises:

a light emitting diode (LED); and a resistor connected in parallel with said light emitting diode that protects said diode from an overcurrent condition.

15. The improvement of claim 11, further comprising:

a current source that energizes said relay switch to close said relay contacts when said first switch means is turned off.

* * * * *

UNITED STATES PATENT AND TRADEMARK OFFICE

CERTIFICATE OF CORRECTION

PATENT NO. : 4,984,543

DATED : January 15, 1991

INVENTOR(S) : PAUL A. THARMAN

It is certified that error appears in the above-identified patent and that said Letters Patent is hereby corrected as shown below:

Claim 1, column 6, line 60, delete "-" (hyphen) between "magneto" and "ignition"; Claim 7, column 7, line 65, delete "selector" and substitute therefore ---starter---; Claim 9, column 8, line 23, delete "sitch" and substitute therefor ---switch---.

Signed and Sealed this

Nineteenth Day of May, 1992

*Attest:*

DOUGLAS B. COMER

*Attesting Officer*

*Acting Commissioner of Patents and Trademarks*